US008312665B2

(12) United States Patent
Moore et al.

(10) Patent No.: US 8,312,665 B2
(45) Date of Patent: Nov. 20, 2012

(54) SIDE-MOUNTED LIGHTING DEVICE

(75) Inventors: Larry E. Moore, Clarkdale, AZ (US); Aaron Moore, Clarkdale, AZ (US)

(73) Assignee: P&L Industries, Inc., Cottonwood, AZ (US)

( * ) Notice: Subject to any disclaimer, the term of this patent is extended or adjusted under 35 U.S.C. 154(b) by 179 days.

(21) Appl. No.: 12/610,213

(22) Filed: Oct. 30, 2009

(65) Prior Publication Data

US 2010/0162610 A1 Jul. 1, 2010

Related U.S. Application Data

(63) Continuation-in-part of application No. 12/249,781, filed on Oct. 10, 2008, and a continuation-in-part of application No. 12/249,794, filed on Oct. 10, 2008, now Pat. No. 7,997,023.

(51) Int. Cl.
*F41G 1/00* (2006.01)

(52) U.S. Cl. ..... 42/114; 42/115; 42/124; 42/125

(58) Field of Classification Search ..... 42/114, 42/115, 124, 125
See application file for complete search history.

(56) References Cited

U.S. PATENT DOCUMENTS

| | | | | |
|---|---|---|---|---|
| 2,268,056 | A | 12/1941 | Nelson et al. | |
| 3,112,567 | A | 12/1963 | Flanagan | |
| 3,510,965 | A | 5/1970 | Rhea | |
| 3,526,972 | A | 9/1970 | Sumpf | |
| 3,573,868 | A | 4/1971 | Giannetti | |
| 3,645,635 | A * | 2/1972 | Steck | 356/252 |
| 3,801,205 | A | 4/1974 | Eggenschwyler | |
| 3,995,376 | A * | 12/1976 | Kimble et al. | 434/22 |
| 4,233,770 | A | 11/1980 | de Filippis et al. | |
| 4,234,911 | A | 11/1980 | Faith | |
| 4,305,091 | A | 12/1981 | Cooper | |
| 4,481,561 | A | 11/1984 | Lanning | |
| 4,488,369 | A | 12/1984 | Van Note | |
| 4,825,258 | A | 4/1989 | Whitson | |
| 4,876,816 | A | 10/1989 | Triplett | |
| 4,878,307 | A * | 11/1989 | Singletary | 42/124 |

(Continued)

FOREIGN PATENT DOCUMENTS

EP 1046877 10/2000

(Continued)

OTHER PUBLICATIONS

EPO; Search Opinion and Report dated Aug. 6, 2010 in Serial No. 09169459.

(Continued)

*Primary Examiner* — Michael Carone
*Assistant Examiner* — Samir Abdosh
(74) *Attorney, Agent, or Firm* — Snell & Wilmer LLP

(57) ABSTRACT

A sighting device is mountable to the side plate of a gun. The sighting device includes a light source (preferably a laser), a power source connectable to the light source. The sighting device is mounted to a gun, usually by being mounted to a side plate, which is then mounted to a gun. In one embodiment, the sighting device is mounted to the side plate by being screwed or bolted to it. In another embodiment, the sighting device includes a recess or channel that receives a rail, such as a dove-tail projection (or protrusion), formed on the side or vice versa. A side plate to which the sighting device can be attached and a gun including the sighting device are also disclosed.

40 Claims, 10 Drawing Sheets

U.S. PATENT DOCUMENTS 4,891,476 A 1/1990 Nation et al.
4,939,320 A 7/1990 Graulty
4,939,863 A * 7/1990 Alexander et al. ..... 42/115
5,001,836 A 3/1991 Cameron et al.
5,033,219 A 7/1991 Johnson et al.
5,177,309 A * 1/1993 Willoughby et al. ..... 42/115
5,178,265 A 1/1993 Sepke
5,237,773 A 8/1993 Claridge
5,241,146 A 8/1993 Priesemuth
5,272,514 A 12/1993 Dor
5,343,376 A 8/1994 Huang
5,365,669 A 11/1994 Rustick et al.
5,367,779 A 11/1994 Lee
5,373,644 A 12/1994 De Paoli
5,375,362 A 12/1994 McGarry et al.
5,388,335 A 2/1995 Jung
5,392,550 A 2/1995 Moore et al.
5,419,072 A 5/1995 Moore et al.
5,432,598 A 7/1995 Szatkowski
5,435,091 A 7/1995 Toole et al.
5,446,535 A 8/1995 Williams
5,448,834 A 9/1995 Huang
5,454,168 A 10/1995 Langer
5,455,397 A 10/1995 Havenhill et al.
5,499,455 A 3/1996 Palmer
5,515,636 A 5/1996 McGarry et al.
5,531,040 A 7/1996 Moore
5,566,459 A 10/1996 Breda
5,590,486 A 1/1997 Moore
5,598,958 A 2/1997 Ryan, III et al.
5,618,099 A 4/1997 Brubacher
5,621,999 A 4/1997 Moore
5,671,561 A 9/1997 Johnson et al.
5,685,636 A * 11/1997 German ..... 362/259
5,694,202 A 12/1997 Mladjan et al.
5,694,713 A 12/1997 Paldino
5,706,600 A 1/1998 Toole et al.
5,787,631 A 8/1998 Kendall
5,842,300 A 12/1998 Cheshelski et al.
5,847,345 A 12/1998 Harrison
5,905,238 A 5/1999 Hung
6,289,624 B1 9/2001 Hughes et al.
6,295,753 B1 10/2001 Thummel
6,345,464 B1 2/2002 Kim et al.
6,363,648 B1 4/2002 Kranich
6,366,349 B1 4/2002 Houde-Walter
6,371,004 B1 4/2002 Peterson
6,499,247 B1 12/2002 Peterson
6,591,536 B2 * 7/2003 Houde-Walter et al. ..... 42/114
6,622,414 B1 9/2003 Oliver et al.
7,134,234 B1 11/2006 Makarounis
7,243,454 B1 7/2007 Cahill
7,260,910 B2 8/2007 Danielson
7,331,137 B2 2/2008 Hsu
7,360,333 B2 4/2008 Kim
7,441,364 B2 10/2008 Rogers et al.
7,584,569 B2 9/2009 Kallio
7,591,098 B2 9/2009 Matthews et al.
7,743,546 B2 6/2010 Keng
7,921,591 B1 4/2011 Adcock
2002/0073561 A1 6/2002 Liao
2002/0134000 A1 9/2002 Varshneya et al.
2002/0194767 A1 * 12/2002 Houde-Walter et al. ..... 42/114
2003/0180692 A1 9/2003 Skala
2005/0044736 A1 3/2005 Liao
2005/0241209 A1 * 11/2005 Staley, III ..... 42/111
2005/0257415 A1 11/2005 Solinsky et al.
2005/0268519 A1 * 12/2005 Pikielny ..... 42/124
2008/0000133 A1 1/2008 Solinsky et al.
2008/0060248 A1 * 3/2008 Pine et al. ..... 42/114
2008/0134562 A1 6/2008 Teetzel
2009/0013580 A1 1/2009 Houde-Walter
2009/0178325 A1 7/2009 Veilleux
2009/0293335 A1 12/2009 Danielson
2010/0058640 A1 3/2010 Moore
2010/0162610 A1 * 7/2010 Moore et al. ..... 42/115
2011/0061283 A1 3/2011 Cavallo
2011/0162249 A1 * 7/2011 Woodmansee et al. ..... 42/114
2012/0047787 A1 * 3/2012 Curry ..... 42/115

FOREIGN PATENT DOCUMENTS

EP 1046877 A1 10/2000

OTHER PUBLICATIONS

EPO; Search Opinion and Report dated Aug. 6, 2010 in Serial No. 09169469.
EPO; Search Opinion and Report dated Aug. 23, 2010 in Serial No. 09169476.
EPO; Examination Report dated Oct. 5, 2011 in Serial No. 09169459.
EPO; Examination Report dated Oct. 5, 2011 in Serial No. 09169469.
Webpage print out from http://airgunexpress.com/Accessories/ referencing various level devices.
Webpage print out from http://secure.armorholdings.com/b-square/smarthtml/about.html referencing background on B-Square and their firearm accessories.
Webpage print out from http://secure.armorholdings.com/b-square/tools_scope.html referencing scope and site tools offered by B-Square.
Webpage print out from www.battenfeldtechnologies.com/113088.html referencing a level device.
Webpage print out from www.battenfeldtechnologies.com/wheeler referencing products from Wheeler Engineering.
Webpage print out from www.blackanddecker.com/laserline/lasers.aspx referencing Black & Decker's Auto-Leveling Lasers.
Webpage print out from www.laserlevel.co.uk/newsite.index.asp referencing the laser devices available on the Laserlevel Online Store.
Shooting Illustrated, "Update on the .25 SAUM" Jul. 2005 pp. 14-15.

* cited by examiner

SIDE-MOUNTED LIGHTING DEVICE

CROSS REFERENCE TO RELATED APPLICATIONS

This application is a continuation in part of and claims priority to U.S. patent application Ser. Nos. 12/249,781, entitled Slot-Mounted Sighting Device; 12/249,785, entitled Gun-Mounted Sighting Device; and 12/249,794, entitled Gun with Mounted Sighting Device, all of which were filed on Oct. 10, 2008 now U.S. Pat. No. 7,997,023. All of these applications are incorporated herein by reference.

FIELD OF THE INVENTION

The present invention relates to a sighting or aiming device for a weapon, particularly a laser that is externally mountable on the side of a gun.

BACKGROUND OF THE INVENTION

As used herein, "light source" means any source of light, such as a laser or flashlight. "Laser" means any form of laser light source that projects a beam of laser light suitable for weapon alignment or sighting purposes. "Sighting device" means a structure or structures that comprise at least a light source and a power source.

It is known to utilize a light beam, such as a beam from a laser, as a sighting aid for weapons, particularly guns. A laser beam is preferred because it has comparatively high intensity, can be focused into a narrow beam with a small divergence angle so it produces a small, bright spot on a target. When the light beam and gun bore are properly aligned, the bullet (or other projectile) will hit on or very close to the location of the spot produced by the laser on the target.

SUMMARY OF THE INVENTION

The inventions are a sighting device for mounting on a side plate of a gun, a gun including the sighting device and a side plate for receiving the sighting device. The sighting device preferably includes a light source (which is most preferably a laser), a power source connectable to the light source, and a mount for mounting the sighting device to the side plate of the gun. In the preferred embodiment, the sighting device is attached to the side plate by being screwed onto the side plate, or by a slot on the sighting device being received in a protrusion on the side plate or vice versa, but the sighting device may be attached to the side plate by any suitable means.

A sighting device according to the invention may also include a secondary light source and/or other device (such a sighting device said to have two outputs), which may be a flashlight with visible light, an infra-red light, a camera, a video recorder, or another laser (infra-red or visible light laser).

A gun according to the invention is preferably a revolver.

DETAILED DESCRIPTION OF PREFERRED EMBODIMENTS

Preferred Sighting Device

Turning now to the drawings where the purpose is to describe a preferred embodiment of the invention and not to limit same, FIGS. 1-10 illustrate preferred embodiments of various aspects of the inventions. Sighting device 10 could be any structure that includes one or more light sources and one or more power sources connectable to the one or more light sources and that can be mounted to a gun in the manner described herein.

Figure 1:
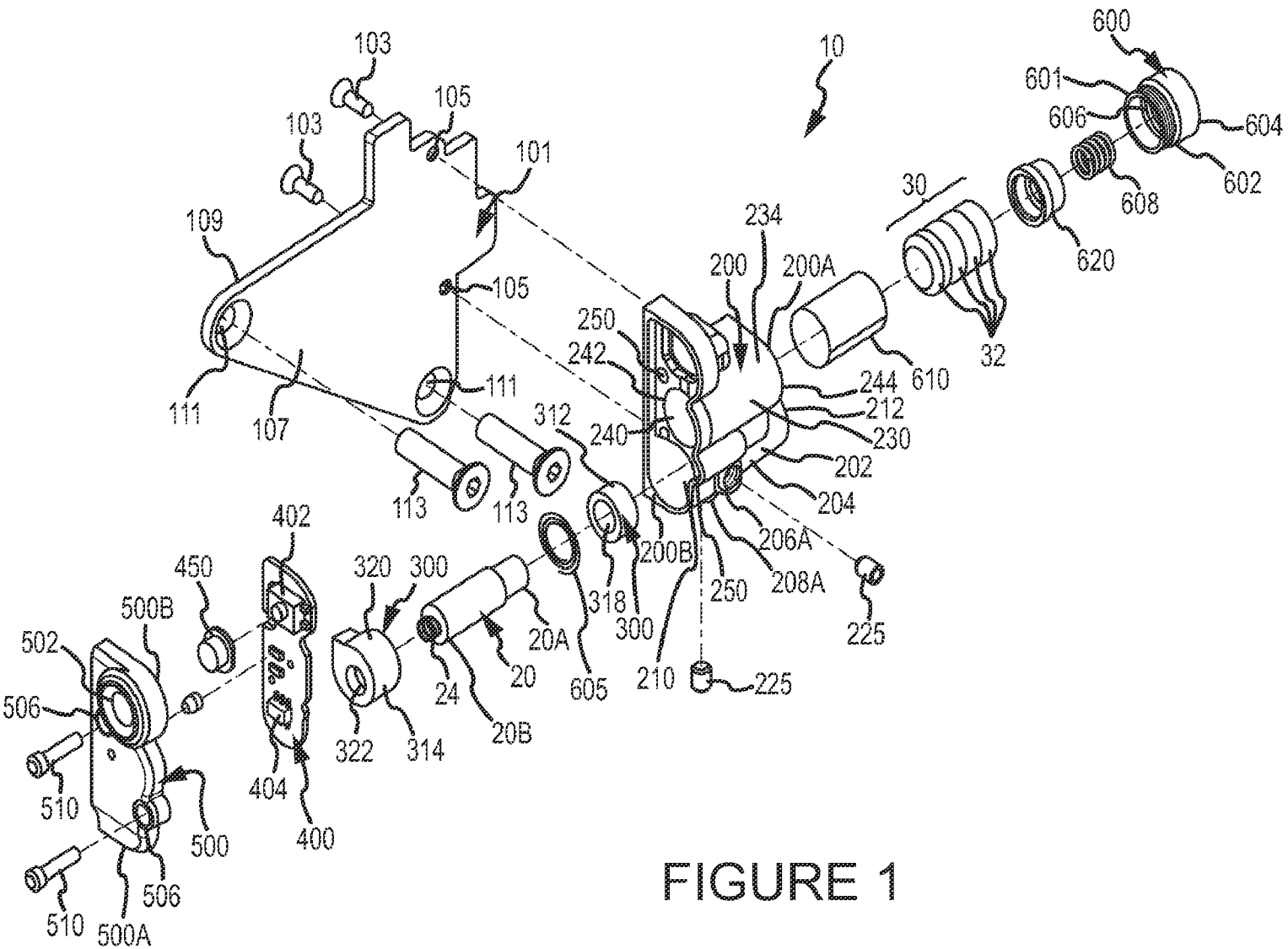
FIG. 1 is an exploded view of an embodiment of a sighting device and side plate of the present invention.

Referring to FIG. 1, a preferred device 10 includes a light source 20 (which is preferably a laser), a power source 30 and a mount 40, which in device 10 is apertures 42 for receiving screws 103 to attach device 10 to side plate 101.

Light source 20 has a first end 20A (through which light can be emitted), a second end 20B. Light source 20 is preferably a visible-light laser module, but could be any lighting device, including a light emitting diode ("LED") flashlight (as used herein "flashlight" means any source of visible light other than a laser) or an infra-red light source (such as an infra-red LED or infra-red laser). In the most preferred embodiment, light source 20 is a red-light, 650 nanometer, 3.3 mm diode, visible laser, and has an overall length of about 14 mm between ends 20A and 20B, and an outer maximum diameter of about 4.5 mm. In the preferred embodiment, it includes a 3 mm focal length, collimating lens. A biasing spring 24 is attached to second end 20B to bias light source 20 towards first end 20A when device 10 is assembled.

Power source 30 can be any suitable power source for light source 20, and is preferably an electric power source and most preferably a portable, electrical power source such as a battery or multiple batteries. The embodiment shown uses four 1-3 silver oxide 1.5V LR626 batteries 32, or alkaline batteries, although any suitable batteries or other power source may be used.

Device 10 as shown further includes a housing 200, a light source adjustment apparatus 300, an integrated circuit board 400, a backing 500, and a battery cap 600. The purpose of housing 200 is to retain light source 20 and power source 30 and mount them to a gun, and to selectively connect power source 30 to light source 20. Any suitable structure or structures may be used for this purpose.

Housing 200 is preferably made of metal injection molded carbon steel or stainless steel (MIM), but could be made of any suitable material, such as another metal (for example, another MIM metal or molded aluminum) or plastic. Housing 200 has a first end 200A, a second end 200B and includes a first canister 202 and a second canister 230. First canister 202 is configured to receive and retain the light source 20 (which is preferably a laser module), which as shown is first positioned in light source adjustment apparatus 300. Once so positioned, apparatus 300, with light source 20 inside, is positioned in and retained in canister 202.

As shown in FIG. 1, canister 202 has an outer surface 204, an inner cavity 210 in which apparatus 300 and light source 20 are retained, and an opening 212 through which the light source 20 can emit light. Canister 202 also includes an aperture 206A that extends into inner cavity 210 and an aperture 208A that extends to inner cavity 210. Each of apertures 206A and 208A are configured to receive a screw 225 (hereafter referred to as "set screw" or "set screws," which are preferably socket-head set screws). Raised Projections 206A and 208A (shown in FIGS. 1, 5 and 6) (each of which project outward about 0.075" from outer surface 204) may be formed in the surface of canister 202 to provide additional area to support set screws 225. Other structures may be used for this purpose or no such structure may be used.

Second canister 230 as shown is spaced apart from first canister 202 and is configured to receive and retain the power source 30. Canister 230 as shown has an outer surface 234, an inner cavity 240, a first end 242 and a second end 244. Second end 244 is configured to open in order to add or change power source 30. In the embodiment shown second end 244 includes internal threads (not shown) that mate with threads 601 on power source retention cap 600 to allow cap 600 to be screwed onto end 244 and screwed off of end 244 in order to add or remove power source 30 from canister 230. A contact spring 605 may be used to create an electrical connection between the modules.

Housing 200 also includes a bottom surface 272 (shown in FIG. 2B) and a mount 102 attached to or integrally formed with bottom surface 272. The mount is for attaching device 10 to a gun (preferably by attaching it to the side plate of a gun, which is then directly attached to the gun) and any suitable structure or structures may be used for this purpose. In the embodiment shown in FIG. 1, the mount comprises apertures 42 that accept screws 103, which fit through apertures 105 in plate 101 and are threadingly received in apertures 42 in bottom surface 272 of housing 200.

Light source adjustment apparatus (or "LSAA") 300 is for retaining the light source 20 when it is positioned in housing 200 and for assisting in positioning light source 20. LSAA 300 serves two purposes: (1) it absorbs the recoil of a gun to which device 10 is mounted thereby enabling light source 20 to remain in a relatively stable position, and (2) it enables a user to adjust the position of light source 20. As shown in FIG. 1, LSAA 300 has a first collar 312 and a second collar 314. First collar 312 as shown is tubular with an annular wall 316, passage 318, and it receives first end 20A of light source 20 in passage 318. Second collar 314 has an outer wall 320, a passage 322 and receives second end 20B of light source 20 in passage 322. Second collar 314 also includes a projection 314A on one side to bias light source 20 to a particular position in chamber 210. Collar 312 and Collar 314 is each preferably comprised of an elastomeric material, such as neoprene rubber, of about a 60 Shore A to absorb shock, but either can be made of any suitable material. As previously described, LSAA 300 fits into inner cavity 210 of first canister 202.

When device 10 is assembled, the position of light source 20 can be adjusted utilizing set screws 225. LSAA 300 is shaped to be biased towards apertures 206A and 208A and, as one or both set screws 225 are tightened, the set screw(s) pushes against LSAA 300 and moves it (in this embodiment) either to the side and/or downward thereby adjusting the position of light source 20.

Integrated circuit board 400 is configured to be received and mounted on second end 200B of housing 200. The basic purpose of board 400 is to connect the power source 30 to the light source 20 and any suitable structure or device can be used for this purpose. Board 400 is preferably fiberglass and includes a push button switch 402, and an integrated circuit 404. Power is transferred via board 400 to laser module 20. Board 400 is designed for negative switching wherein power is generated from the negative side of power source 30 (which are batteries in this embodiment) and through spring 24 of light source 20 in this embodiment. Integrated circuit 404 allows for the pulsed delivery of power to light source 20 (preferably about 1,000 cycles per second, and preferably pulsing at a 50% on duty rate) in order to save power and power source life, although the delivery of power need not be pulsed, or can be pulsed in any suitable manner. In this embodiment, the light source has between about an 8 and 15 milliamp draw, and most preferably less than a 10 milliamp draw, of current when in use and utilizing the 1,000 pulses per minute delivery of current to light source 20.

A button 450 is of any suitable shape to fit with push button switch 402 and backing 500, described below. Button 450 is for enabling a user to selectively activate switch 402 thus turning the light source 20 off and on, and any suitable device or structure in any suitable location can be used for this purpose. The user may selectively activate button 450 with his/her finger with a pushing motion, though any suitable force may be utilized to activate button 450.

Backing 500 is preferably aluminum and its purpose is to hold integrated circuit board 400 to housing 200 and to protect integrated circuit board 400 and the other components inside of housing 200. Backing 500 has a first side 500A configured to fit over canister 202 at end 200B and a second side 500B configured to fit over end 242 of canister 230. It further includes an opening 502 through which button 450 projects so it can be pressed by a user to turn light source 20 on and off, and openings 506 that align with screw retainers 250. Screws 510 are then received through openings 506, and are threaded into retainers 250 to hold device 10 together.

Power source retention cap 600 has a threaded end 602 and an end 604 that can be tightened or loosened by a user. The purpose of cap 600 is to selectively open and close second canister 230 to allow power source 30 to be removed or inserted and any structure capable of performing this function can be used. Cap 600 has a cavity 606 that receives a spring 608 to bias batteries 32 away from spring 608. Spring 608 contacts the positive side of the power source 30 and grounds it to the housing 200 through cap 600. As explained below, a rubber biasing collar 620 may also be utilized with cap 600.

Figure 3:
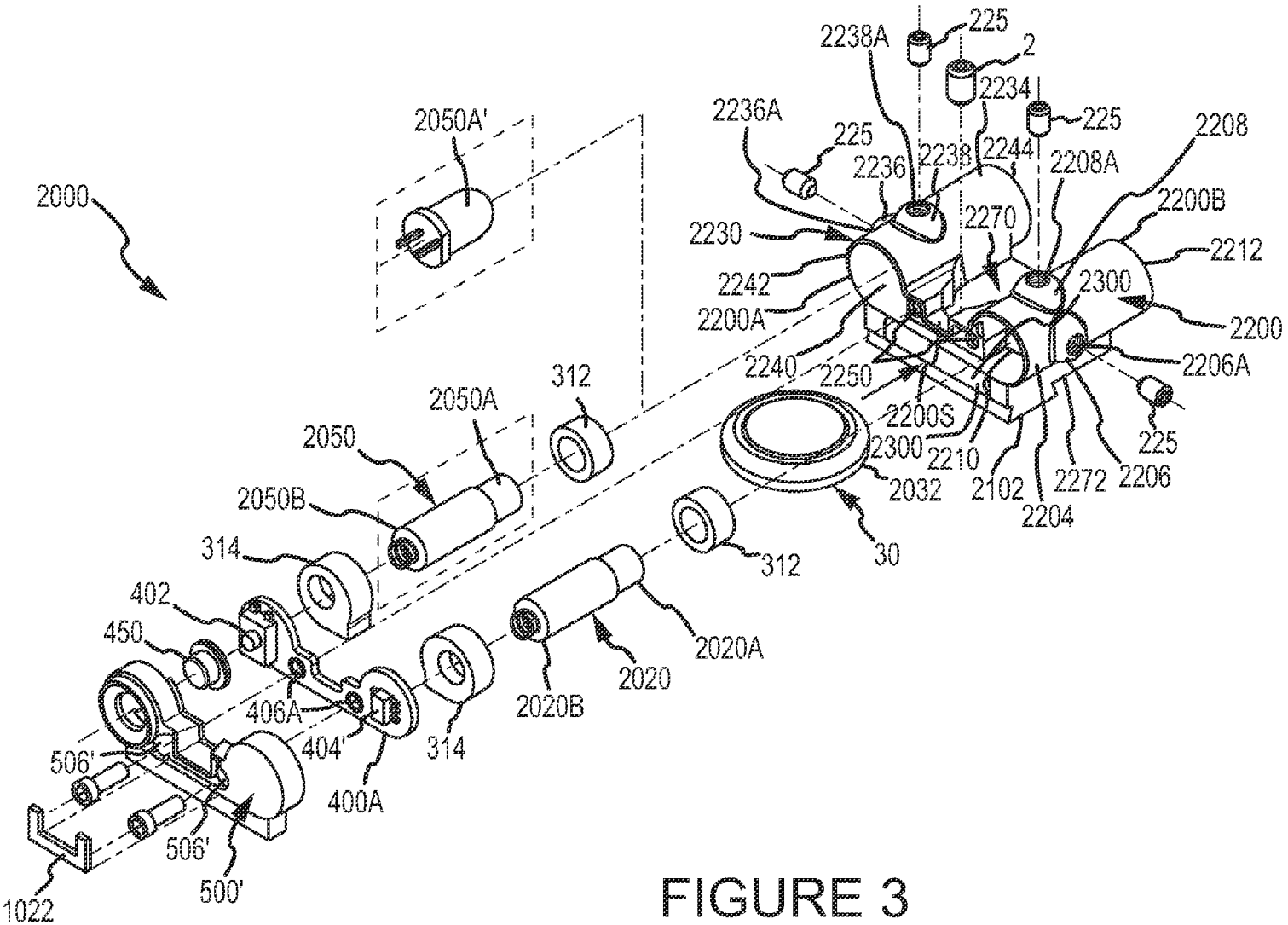
FIG. 3 depicts a device according to the invention that has two outputs.

FIG. 3 shows a device 2000 according to the invention that includes two outputs, one of which could be a lighting device and the other of which could be any type of other suitable output. For example, device 2000 may have two lighting devices and/or image capture device(s) or some combination thereof. Each light source and/or image capture device could be of any type, such as a visible laser, an LED flashlight, camera, video camera, an infra-red LED, or an infra-red laser. Any combination of functional devices is possible and, if the light sources are used, each light source may emit the same type of light or may emit different types of light. For example, one light could be a visible laser and one could be an LED flashlight, or both could be visible lasers, or one could be an infra-red laser and the other could be an infra-red LED. Each of the respective lighting devices image capture devices or combination thereof may be operated independently of one another, or may both be operated simultaneously. For example, an LED flashlight and visible laser may simultaneously be operated to enable a user to simultaneously see in a dark area and sight the gun. Image capture devices may be activated by a button and/or force of the firing of the weapon. Captured images and/or additional data may be stored in a memory coupled to the image capture device.

As shown, the two lighting devices are on top of each other and device 2000 is configured to be on the side surface of a gun. However, one light source could be side by side or one light source could be on the side surface of the gun and another on a different side surface and/or top surface.

Preferred Side Plate

Preferably, device 10 is configured to be mounted on a side plate formed on or mounted to a side surface of a gun. In the embodiment shown, device 10 is mounted to a side plate 101. Side plate 101 can be of any suitable dimension and material, and its dimensions and shape will likely vary based on the type of gun. Preferably, the side plate 101 is about 1/16" thick and is half to full hardness stainless steel or carbon steel although any suitable material may be used.

Figure 2A:
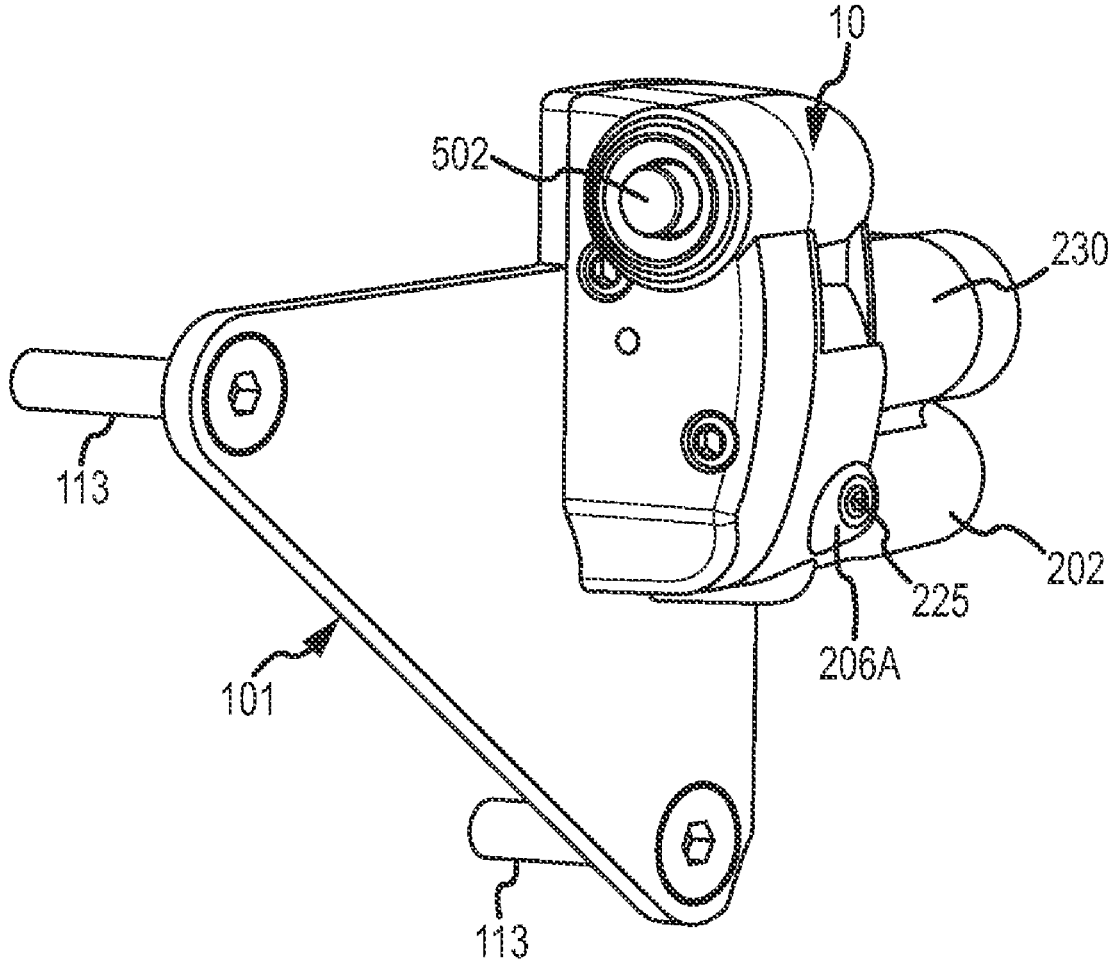
FIG. 2A is a rear perspective assembled view of the device shown in FIG. 1.
Figure 2B:
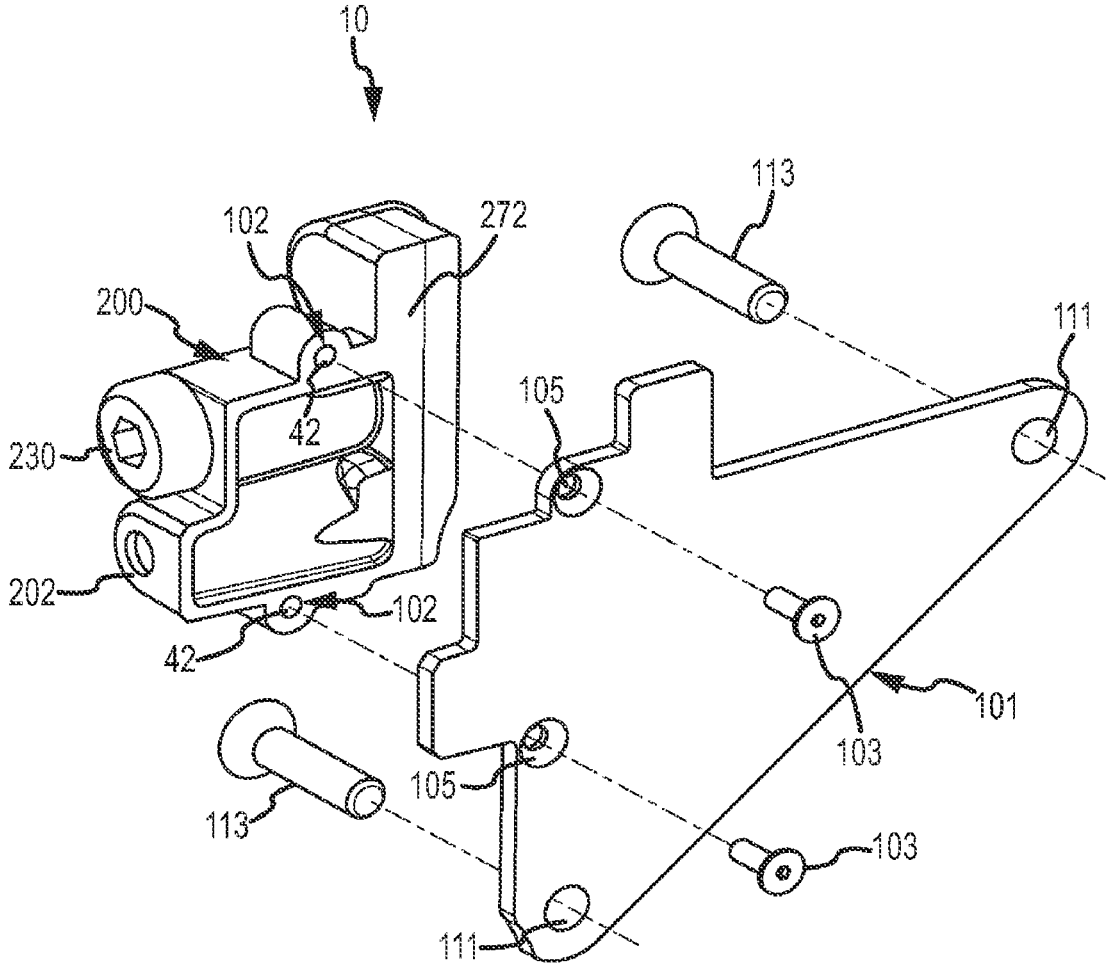
FIG. 2B an exploded view showing the rear of the side plate of FIGS. 1 and 2A before being assembled to a sighting device.

As shown in FIGS. 1 and 2B, apertures 105 are formed in through plate 101 for receiving screws 103. In one embodiment an existing aperture of the gun is utilized to secure the plate 101 to the gun. In one embodiment a plurality of apertures and respective screws are included in plate 101.

Plate 101 may be attached to a gun by any suitable manner such as by one or more screws, bolts and/or on adhesive, although screws are the most preferred method. In the preferred embodiment, existing aperture(s) on the gun are used to connect the plate 101 to the gun and the grip of the gun does not have to be removed to connect the plate 101 to the side surface of the gun.

Figure 4:
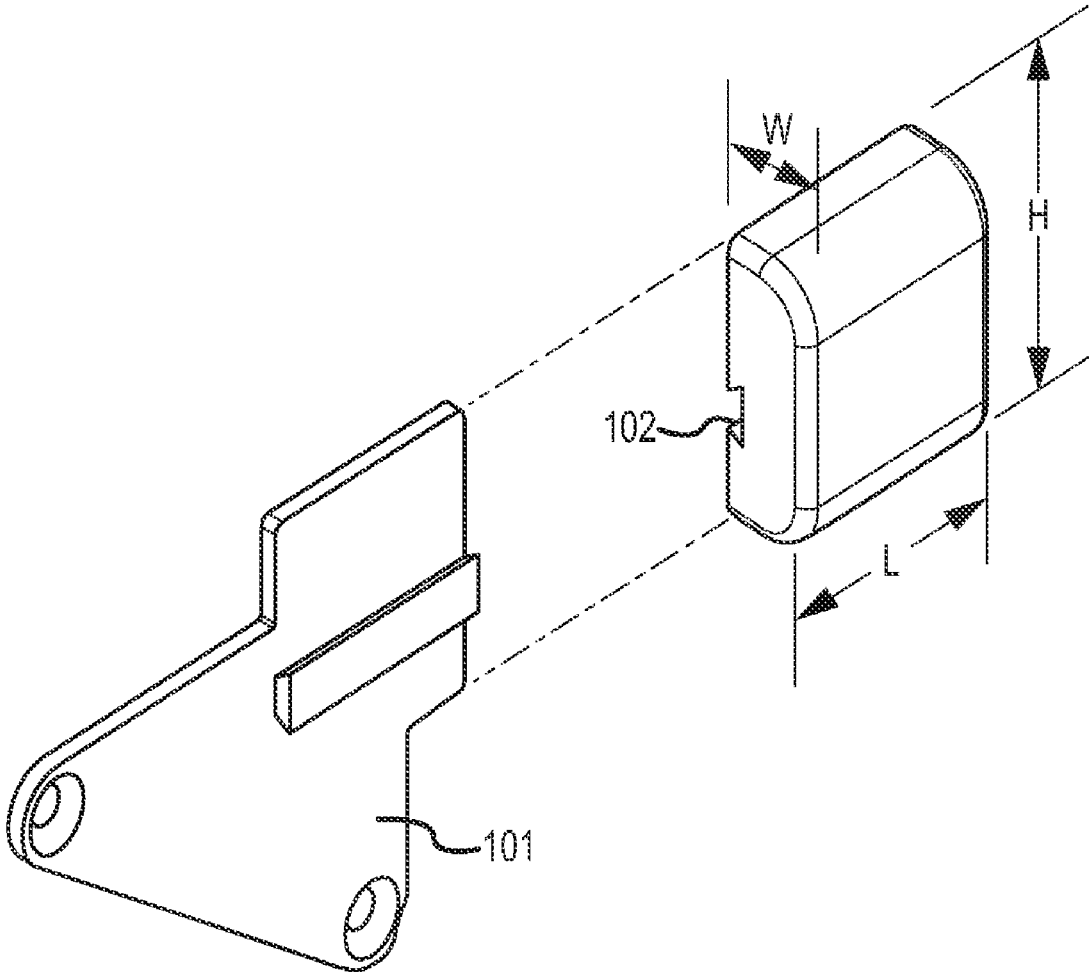
FIG. 4 illustrates an embodiment of the present invention wherein the side plate has a dove-tail protrusion and the device (shown as a black box without specific detail) has a dove tail slot configured to receive the protrusion.

FIG. 4 depicts a side plate 101' according to one embodiment of the invention. In this embodiment plate 101' and a sighting device 10' are coupled by a dove-tail rail (or dove-tail projection) 110 in plate 101'. In this embodiment the dove tail recess 102 is shown on sighting device 10' and the projection 110 is shown on the plate 101', however, the recess may alternatively be located on plate 101' and the projection on sighting device 10'.

Plates 101 and 101' are each preferably flush with the side surface of the gun. Plate 101 or 101' may have additional apertures or channels (not shown) for running wires to couple elements of a mounted sighting device.

Figure 5:
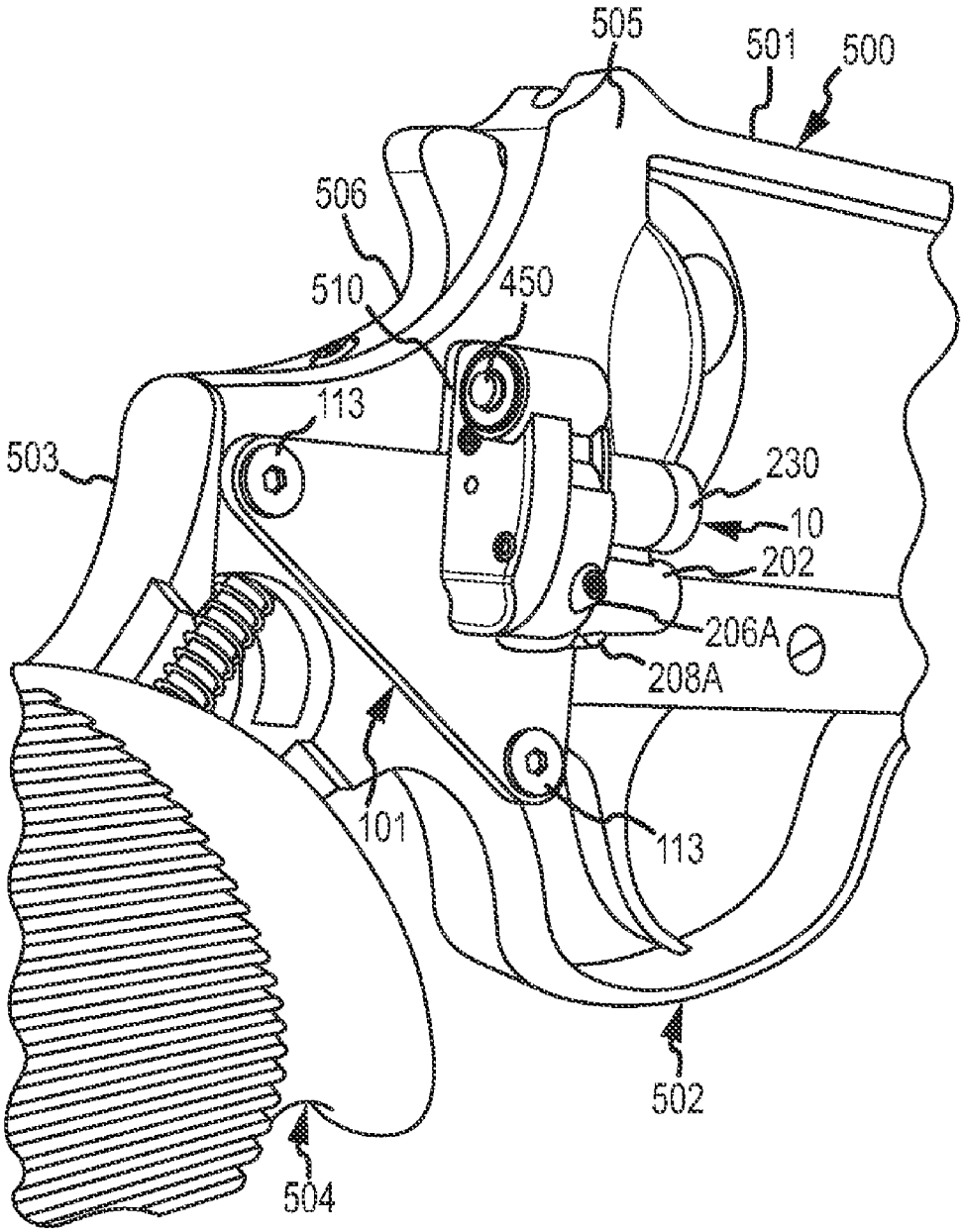
FIG. 5 depicts a side plate and sighting device according to the invention mounted on a revolver.
Figure 6:
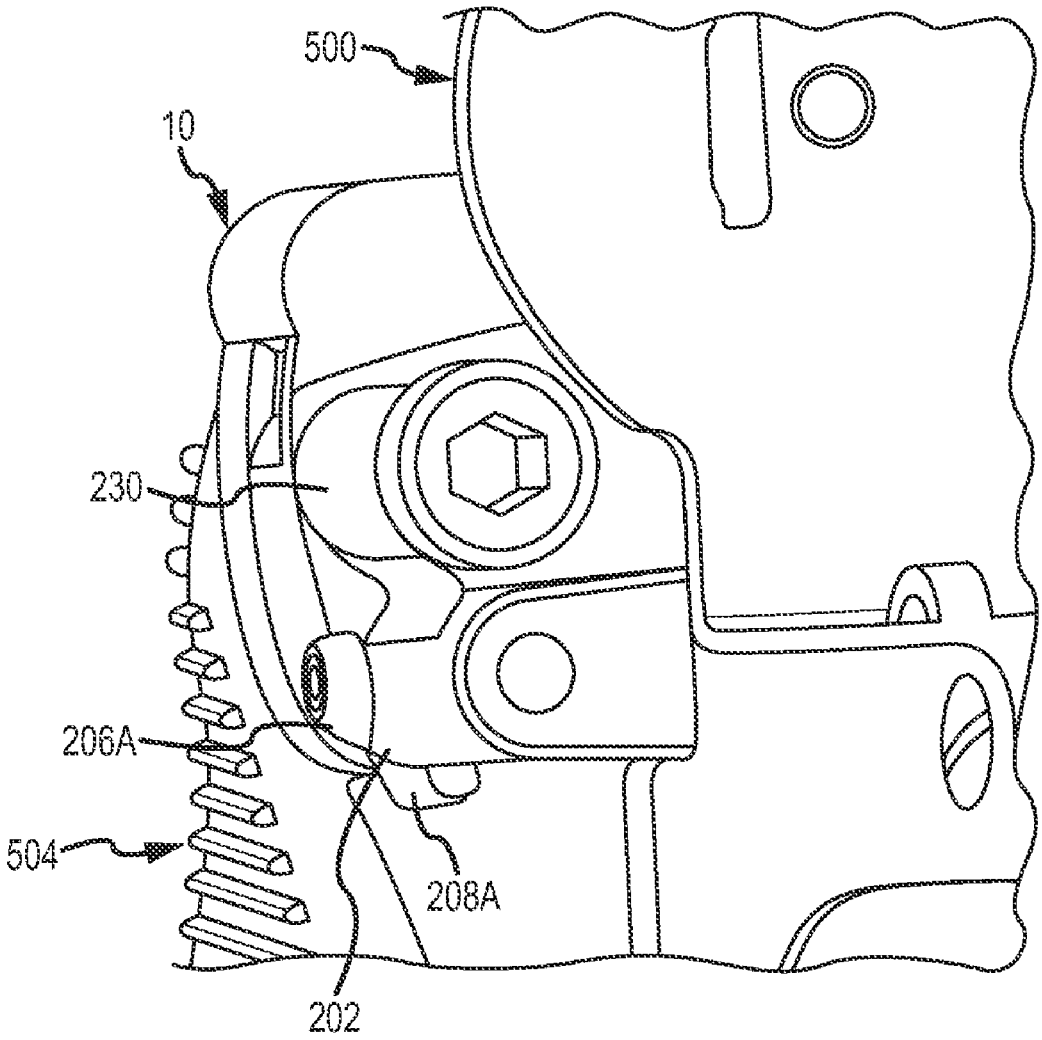
FIG. 6 is a close-up, front view of the device of FIG. 5.
Figure 7:
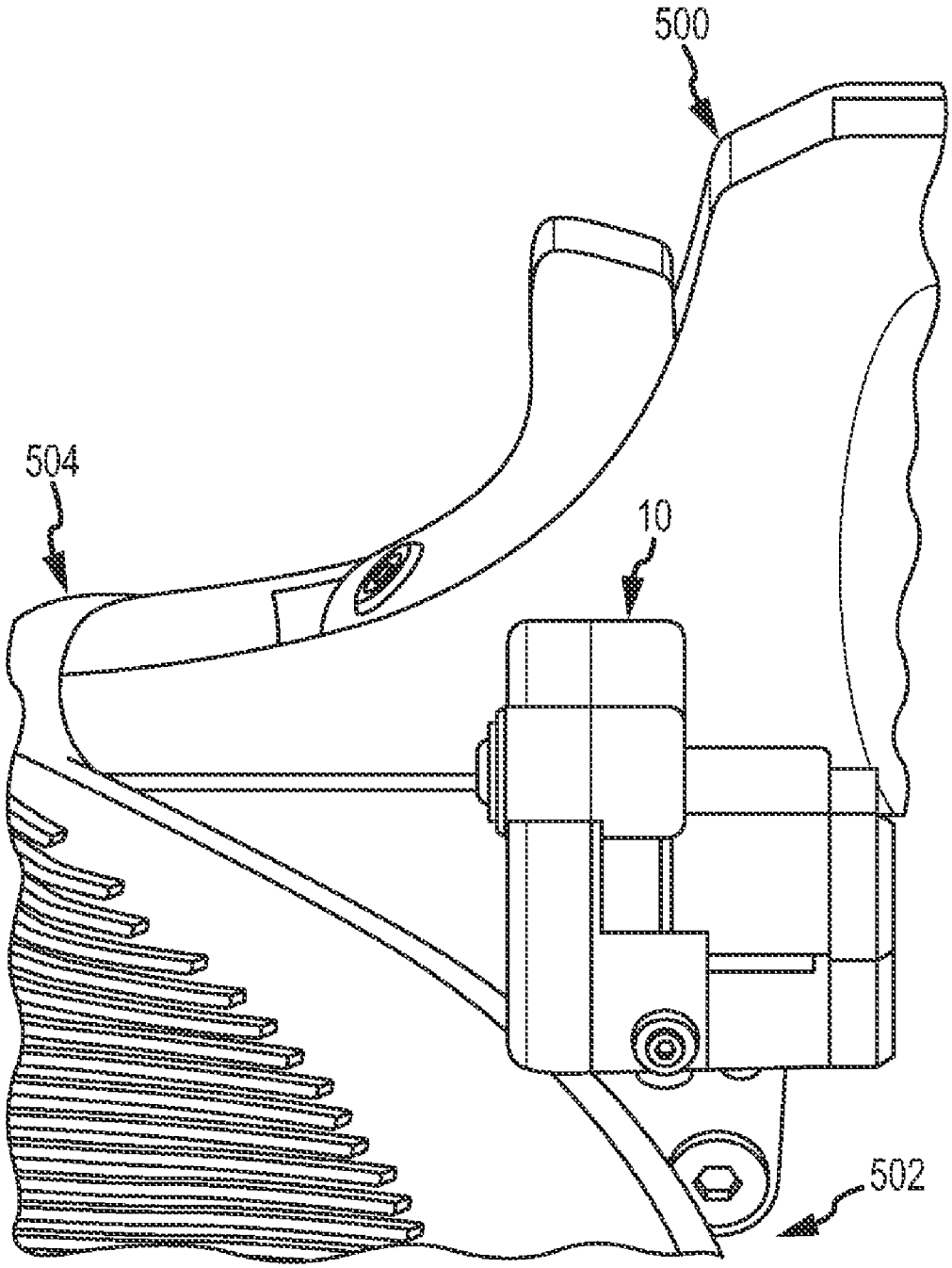
FIG. 7 is a side, close-up view of the device of FIG. 5 showing the grip of the revolver.
Figure 8:
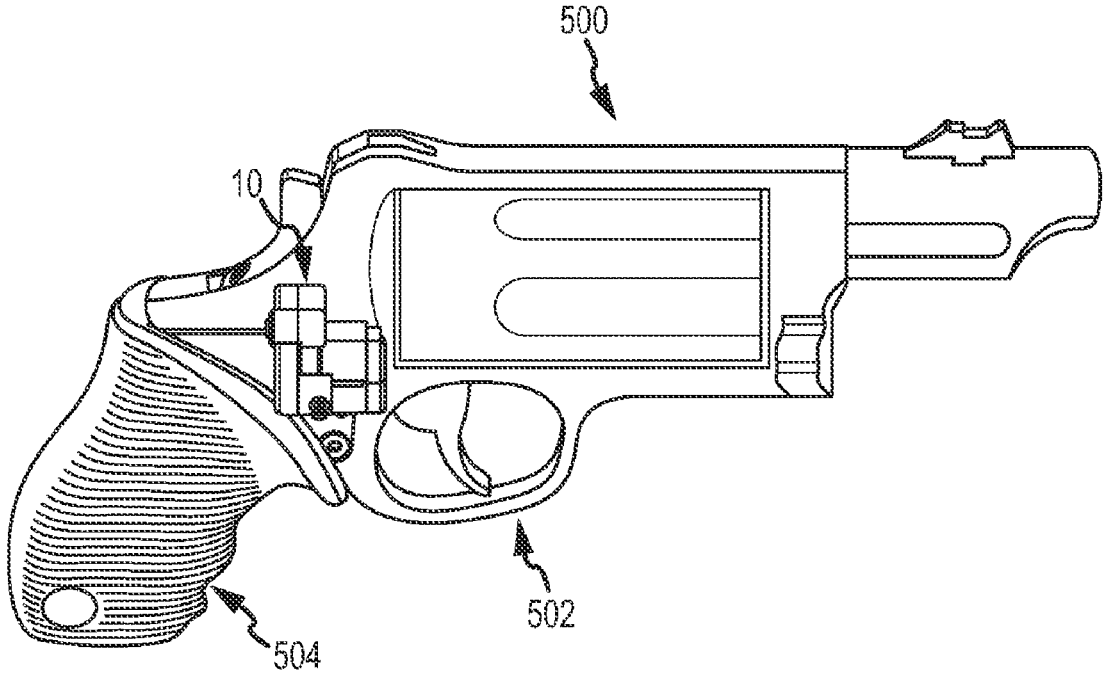
FIG. 8 is a side view of the device and revolver shown in FIGS. 6 and 7.
Figure 9:
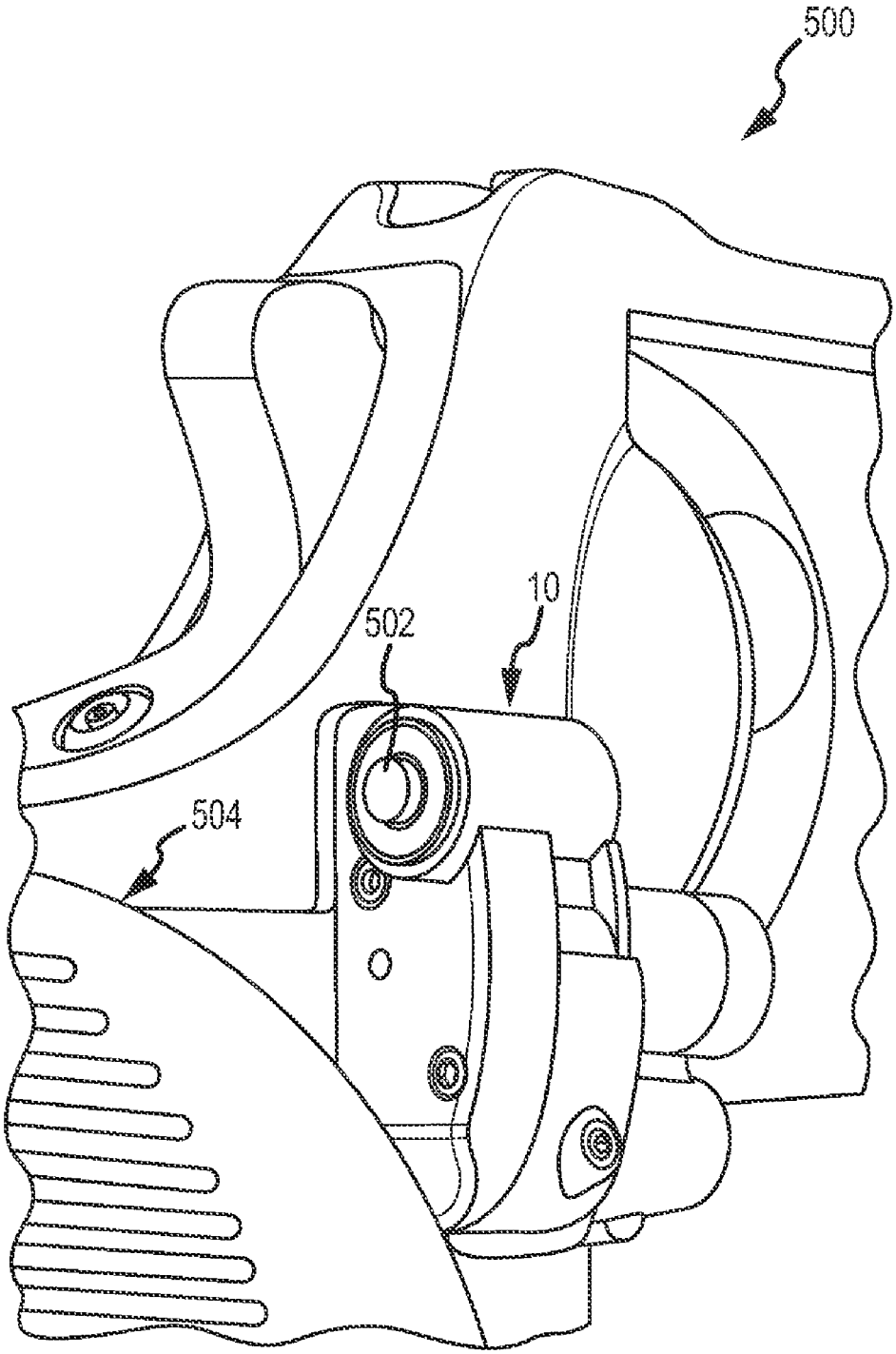
FIG. 9 is a rear, close-up, perspective view of the device and revolver shown in FIGS. 6-8.

FIG. 5 shows a sighting device 10 according to the invention mounted on the side 2008 of a gun. In this embodiment the mounting of the sighting device does not overlap the grip 2012 of the gun.

When mounted on a gun, sighting device 10, sighting device 10', or any alternate sighting device according to the invention, preferably extends outward a width W (shown in FIG. 4) from the side plate no farther than about ¾", ½", or preferably about 0.4", or no farther than about ⅜". Device 10, device 10', or any alternative sighting device according to the invention, preferably has an entire length L when assembled (as shown, for example, in FIG. 4) of less than 3", or less than 2", or less than 1½", less than 1" and preferably about 0.85", and preferably has a height H (as shown, for example, in FIG. 4) of less than ¾", or less than ½" and preferably about ⅜".

As shown, when mounted on a gun, a sighting device according to the invention is preferably positioned rearward of (or behind) the trigger guard and is not on, inside of or part of the grip. If used on a revolver, it is preferable to mount the sighting device on the side opposite the side to which the revolver cylinder opens for reloading.

Preferred Gun

A preferred gun is a revolver, although a sighting device according to the invention can be used on any gun having the proper configuration for the sighting device to be mounted thereon. FIGS. 5-9 show one embodiment of a gun 500 with which a device (device 10 is shown in this embodiment) according to the invention can be used. Gun 500 is a revolver pistol.

A preferred gun 500 includes a top surface 501, a rear surface 503, two side surfaces 505 and 506, a handle or grip 504, and a trigger guard 502. As shown, plate 101 is positioned on the side surface 505 of gun 500 by screws 113.

A device according to the invention should be positioned such that at least one of the light sources or outputs is not blocked by the revolver cylinder. As shown, when device 10 is mounted on revolver 500, light source 20 projects a light beam below the bottom of the cylinder. A device according to the invention could also be positioned so as to project a light above the cylinder.

The device is also preferably of a configuration wherein the cylinder can be opened without removing the sighting device (as shown, and as is most common, the cylinder opens to the user's left, away from the side on which sighting device 10 is mounted in the figures). Preferably, the on-off button 502 is positioned ⅝" to ¾" above the central, longitudinal axis of the lower module (canister), which for device 10 is 200 that retains a light source such as a laser. The device is also mounted so button 502 is preferably ½" or more behind the cylinder. The center of the grip defier 520 of the trigger is preferably between ¾" and 1½" and most preferably about 1" lower than the aperture of the second cylinder 200, as measured in a straight vertical line, and is preferably between ¼" and ¾", and most preferably about ⅜", behind the grip defier 520, as measured along a horizontal line.

Having thus described preferred embodiments of the invention, other variations and embodiments that do not depart from the spirit of the invention will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired result.

What is claimed is:

1. A gun including a muzzle with a bore, a grip, a cylinder, a trigger guard, a trigger, a side plate and a sighting device mounted on the side plate, the sighting device positioned behind the trigger and behind the cylinder, the sighting device having a light source, a power source and a light source adjustment apparatus for adjusting the position of the light source, wherein the light source adjustment apparatus includes an inner cavity that retains at least part of the light source.

2. The gun of claim 1, wherein the sighting device has a bottom surface with apertures therein, the sighting device being mounted to the side plate by screws passing through the side plate and being received and retained in the apertures.

3. The gun of claim 1, wherein the sighting device has a first canister that includes the light source and a second canister that includes the power source.

4. The gun of claim 1, wherein the light source is a laser.

5. The gun of claim 1, wherein the light source projects a beam of light that passes underneath the cylinder.

6. The gun of claim 1, wherein the sighting device further includes an off/on switch and circuitry connecting the off/on switch to the power source and the light source.

7. The gun of claim 1, wherein the light source is a laser.

8. The gun of claim 1 that is a revolver.

9. The gun of claim 1, wherein the sighting device extends outward from the side plate by ¾" or less.

10. The gun of claim 1, wherein the sighting device extends outward from the side plate by ½" or less.

11. The gun of claim 1, wherein the sighting device is attached to the side plate by screws and the side plate is attached to the gun by separate screws.

12. The gun of claim 1, wherein the sighting device extends outward from the side plate by about 0.4" or less.

13. The gun of claim 1, wherein the power source is one or more batteries.

14. The gun of claim 13, wherein the power source is a plurality of 1-3 V silver oxide or alkaline batteries.

15. The gun of claim 14, wherein the power source is spaced apart from the light source.

16. The gun of claim 1, wherein the sighting device includes a housing having a first canister and a second canister and a connective portion therebetween.

17. The gun of claim 16, wherein at least part of the housing is comprised of metal.

18. The gun of claim 16, wherein at least part of the housing is comprised of steel.

19. The gun of claim 17, wherein at least part of the housing is comprised of stainless steel.

20. The gun of claim 1, wherein the sighting device is no greater than 3" in length.

21. The gun of claim 1, wherein the sighting device is no greater than 2" in length.

22. The gun of claim 1, wherein the sighting device is no greater than 1½" in length.

23. The gun of claim 1, wherein the sighting device is no greater than about 0.85" in length.

24. The gun of claim 1, wherein the sighting device has a height of less than ¾".

25. The gun of claim 1, wherein the sighting device has a height of less than ½".

26. The gun of claim 1, wherein the sighting device has a height of about ⅜".

27. The gun of claim 6, wherein the first canister has a central, longitudinal axis and sighting device has an off-on switch located ⅝"-¾" above the central, longitudinal axis.

28. The gun of claim 1, wherein the sighting device has an off-on switch positioned at least ½" behind the cylinder.

29. The gun of claim 6, wherein the first canister has a central, longitudinal axis and the gun includes a trigger having a grip defier with a center, the central, longitudinal axis of the first canister being between ¾" and 1½" above the center of the trigger.

30. The gun of claim 6, wherein the first canister has an aperture through which light is emitted and the gun includes a trigger having a grip defier with a center, the aperture being between ¼" and ¾" behind the center of the trigger as measured along a horizontal line.

31. The gun of claim 1, wherein the light source pulses when it emits light.

32. The gun of claim 31, wherein the light source pulses at 1000 times per second when it emits light.

33. The gun of claim 1, wherein the light source draws less than 10 milliamps of power when it emits light.

34. The gun of claim 33, wherein the light source draws 6-8 milliamps of power when it emits light.

35. The gun of claim 31, wherein the light source has a 50% duty cycle as it pulses.

36. The gun of claim 1, wherein the sighting device further includes a secondary light source.

37. The gun of claim 36, wherein the secondary light source is spaced apart from the light source.

38. The gun of claim 36, wherein the light source and the secondary light source are each connectable to a power source.

39. The gun of claim 36, wherein the light source and the secondary light source can simultaneously omit light.

40. The gun of claim 36, wherein the secondary light source is a LED flashlight.

* * * * *